US005229781A

United States Patent [19]

Losquadro et al.

[11] Patent Number: 5,229,781

[45] Date of Patent: Jul. 20, 1993

[54] FINE POINTING SYSTEM FOR REFLECTOR TYPE ANTENNAS

[75] Inventors: Giacinto Losquadro; Mario Falconi, both of Rome, Italy

[73] Assignee: Selenia Spazio S.p.A., L'Aquila, Italy

[21] Appl. No.: 677,625

[22] Filed: Mar. 28, 1991

[30] Foreign Application Priority Data

Mar. 28, 1990 [IT] Italy ..... 47799 A/90

[51] Int. Cl.[5] ..... H01Q 3/020; H01Q 1/120

[52] U.S. Cl. ..... 343/766; 343/763; 343/882

[58] Field of Search ..... 343/757, 761, 763, 765, 343/766, 882; 248/178, 179, 183

[56] References Cited

U.S. PATENT DOCUMENTS

| | | | |
|---|---|---|---|
| 3,696,432 | 10/1972 | Anderson et al. | 343/757 |
| 4,070,678 | 1/1978 | Smedes | 343/757 |
| 4,550,319 | 10/1985 | Ganssle et al. | 343/DIG. 2 |
| 4,862,185 | 8/1989 | Andrews et al. | 343/761 |
| 5,091,733 | 2/1992 | Labruyere | 343/882 |

FOREIGN PATENT DOCUMENTS

| | | | |
|---|---|---|---|
| 2646023 | 10/1990 | France | 343/882 |
| 0074402 | 4/1986 | Japan . | |
| 2114376 | 8/1983 | United Kingdom | 343/880 |

OTHER PUBLICATIONS

Patent Abstracts of Japan, vol. 8, No. 231 (E-274)(1968) Oct. 24, 1984 and JP-A-59 112 703 (Nippon Denshin Denwa Kosha) Jun. 29, 1984.

Review of the Electrical Communication Laboratories, vol. 35, No. 2, Mar. 1987, Kawakami et al. "On-Board Antenna Pointing Control System For Multi-Beam Communications Satellite."

*Primary Examiner*—Rolf Hille
*Assistant Examiner*—Peter Toby Brown
*Attorney, Agent, or Firm*—Cohen, Pontani, Lieberman, Pavane

[57] ABSTRACT

A pointing system for reflector type antennas providing a high degree of accuracy with low loss over wide scan areas, including a fixed illuminator retained in fixed position at the focal point of the reflector of the antenna. Surrounding the illuminator is a Cardanic joint which acts as a spherical hinge capable of radial rotation around the illuminator. Attached to the Cardanic joint is a support arm which is connected to the reflector. The reflector is therefore freely movable in a spherical path defined around the illuminator with the illuminator coinciding with the center of the sphere. The illuminator is kept within the focal point of the reflector regardless of the position of the reflector as it spherically rotates around the illuminator. Tension springs in the Cardanic joint and guide wires controlled by motors are provided for finely positioning the support arm and reflector in any given position along the spherical rotative path through which the reflector is able to move. The beam axis of the antenna is continuously variable through the complete range of motion of the reflector, and therefore the antenna system is capable of scanning over large areas. The fine positioning of the reflector and the lack of need for articulated connectors to the feed of the antenna provide for low loss and high pointing accuracy.

5 Claims, 3 Drawing Sheets

FINE POINTING SYSTEM FOR REFLECTOR TYPE ANTENNAS

FIELD OF THE INVENTION

The present invention relates to finely controlled aiming or pointing of reflector type antennas. The invention permits the movement of a reflector around a fixed illuminator thereby eliminating the need for any articulated connection to the illuminator such as articulated wave guide joints or articulated coaxial cable connectors, which in turn eliminates the losses associated with such articulated connections from the system. The overall performance of the antenna is further improved by the precise aiming of the overall antenna which is attained using the inventive apparatus.

BACKGROUND OF THE INVENTION

Conventional pointing systems for the correct positioning of reflecting antennas have typically been implemented using actuators connected to the reflector which could tilt the reflector on a hinge fixed at a given point on the reflector. Such systems are known to generate distortions which increase in magnitude as a function of the scan angle of the antenna as it is being pointed. This in turn leads to large reductions in the antenna gain, side lobe increases, or asymmetric antenna patterns. The limitations imposed by these systems have made them suitable only for rather limited scan angles or in antennas which require designs wherein the focal length to parabolic diameter ratio (F/D) is very large and therefore impractical.

These are other known systems for moving the entire antenna and its feed system which have complex, multiple degrees of freedom. These systems, however, require the use of jointed wave guides or jointed coaxial cables for the antenna feed. These jointed connectors are expensive, and impose Radio Frequency ("RF") losses into the system, therefore making them relatively undesirable.

It would therefore be advantageous to have an antenna system which can allow extensive freedom of movement of the reflector while the antenna feed or illuminator remains fixed, thereby providing increased pointing flexibility and accuracy while eliminating the need for articulated feed joints which increase the expense of, and impose losses on, the system.

OBJECTS AND SUMMARY OF THE INVENTION

The antenna system of the present invention provides for the accurate pointing of reflector type antennas without the inherent expense or losses normally associated with presently known highly articulated systems. The present system comprises a fixed illuminator positioned at the focal point of the reflector of the antenna. This illuminator is fixedly mounted so that the RF connections made to it can be non-articulating. Surrounding the illuminator is a Cardanic (i.e. universal) joint. The joint acts as a spherical hinge having the illuminator as its rotation center. Connected to the Cardanic joint is an arm upon which the reflector is mounted. The arm is positioned for maintaining a constant distance between the reflector and the illuminator, so that the illuminator is held continuously within the focal point of the reflector. The pivots of the Cardanic joint are fitted with circular springs which tend to impart rotative movement to the arm. Fixed to the arm are guide wires controlled by motors which have capstans around which the wires are wound, thereby allowing selective shortening and lengthening of the wires and applying selective tension to the arm. The tension exerted by the wires tends to counter the rotative forces exerted by the springs within the joint. Therefore, by selectively lengthening or shortening the guide wires connected to the arm, the arm can be carefully and guidedly moved through the entire range of motion of the Cardanic joint with great precision. Since the arm is designed for maintaining the illuminator within the focal point of the reflector at all times, the antenna can be pointed in a great number of positions, limited only by the articulated range of motion of the Cardanic joint. Further, since the illuminator is fixed, there are no losses in the system due to articulating joints from the wave guide or coaxial cable feeding the illuminator. Additionally, since the reflector can be freely rotated around the focal point with great precision, an improved scan field with low losses can be achieved.

It is therefore an object of this invention to provide an antenna capable of pointing with great accuracy across a very broad scan field with low losses.

It is a further object of this invention to provide an antenna system wherein the illuminator is fixed relative to the free movement of the reflector, therefore eliminating the need for any movable joints in the feed system, thereby eliminating the losses inherent in those connections.

It is a further object of this invention to provide an antenna system particularly suited for satellite applications due to its lightweight and compact design as compared to prior art highly articulated systems.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
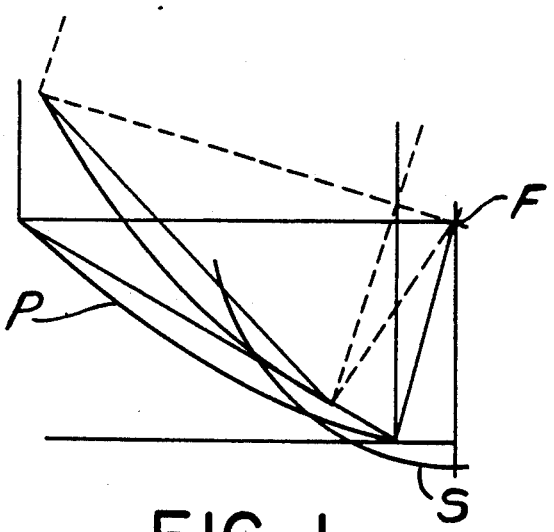
FIG. 1 represents the spherical movement of a parabolic shape which maintains a continuous focal point throughout the range of spherical rotation of the parabolic shape.

In FIG. 1, a parabolic shape is rotated around a spherical path wherein the center of the sphere which defines the path and the focal point of the parabolic shape are coincident, the parabola can be moved in any direction along any point on the spherical path while the distance relationship between the parabola and its focal point remains constant. In an antenna system, if the reflector was the parabola previously mentioned, and the focal point was a position at which the illuminator of the antenna was located, the antenna can be made to point in any number of directions as the parabola moves along a spherical path. In this way the antenna beam axis can be made to scan as the reflector moves around the illuminator, as long as the illuminator remains within the focal point of the reflector.

Figure 2:
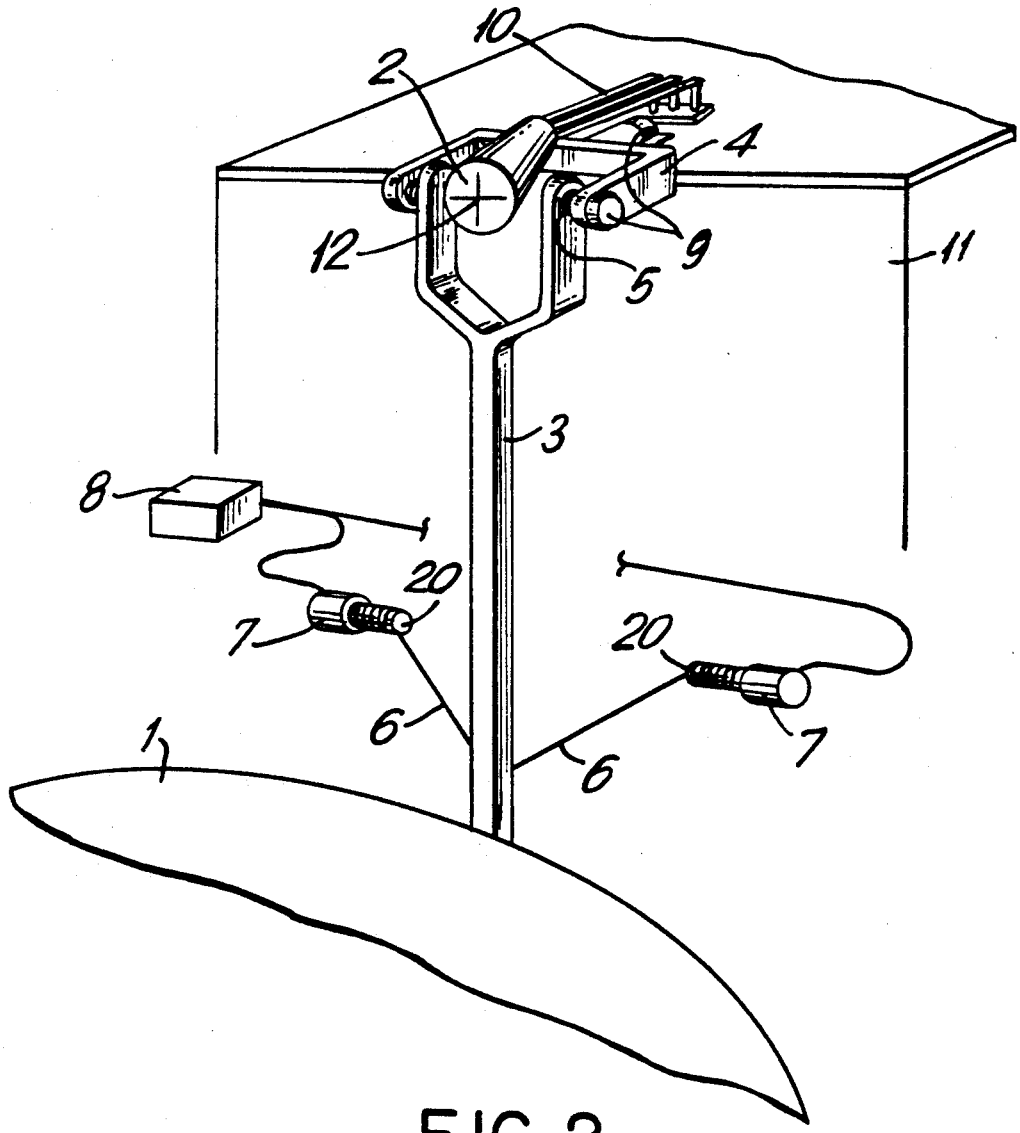
FIG. 2 is a partial view of the antenna pointing system of the present invention.

Referring now to FIG. 2 which is a diagrammatic representation of the antenna system of the present invention, the illuminator 2 is seen positioned at the focal point 12 of the reflector 1. The illuminator 2 is mounted to a fixed structure 11. The illuminator 2 is fed by Radio Frequency (RF) connectors 10. Since illuminator 2 is mounted to fixed structure 11, the RF connectors 10 are fixed connectors, not requiring any articulating capability. Also mounted to fixed structure 11 is a Cardanic (i.e. universal) joint 4. The universal joint 4 is constructed such that the illuminator 2 which resides at focal point 12 is continuously oriented within the open central portion of the joint 4. Thus the joint 4 is free to rotate around the illuminator 2 while illuminator 2 remains in fixed position at focal point 12. The joint 4 is connected at one end to fixed structure 11, while the other end of the joint 4 is connected to reflector support arm 3. Support arm 3 has a length such that the reflector 1 maintains a uniform distance from illuminator 2, and also maintains the focal point of the reflector 1 at focal point 12, where illuminator 2 lies. Thus, arm 3, and in turn reflector 1, are freely rotatable around the illuminator 2 at a fixed distance which with the focal length of the reflector.

Figure 3A:
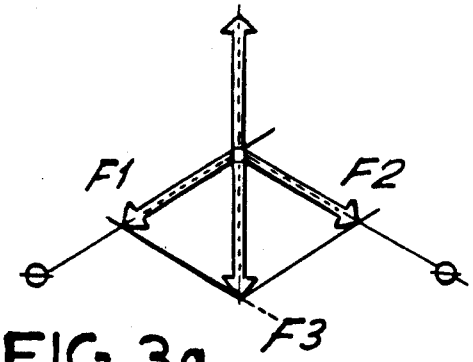
FIGS. 3A and 3B are force vector diagrams demonstrating the distribution of forces in the antenna system of the present invention.
Figure 3B:
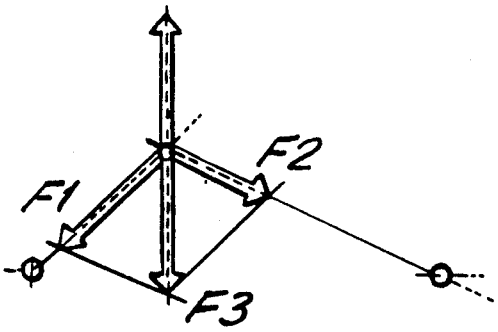

Support arm 3 is controlled in its movement by motors 7, which have grooved capstans 20 around which guide wires 6 are wound. The guide wires 6 are in turn connected to support arm 3 at a point near the reflector 1. Additionally, the pivots at the central portion of joint 4 are equipped with springs 5. Springs 5 are circular tension springs which are pretensioned to impart pivotal motion of support arm 3 around the central pivoted portion of joint 4. This tendency to move pivotally is constrained by the tension supplied by wires 6. Therefore, as motors 7 selectively lengthen or shorten the wires 6, the tension exerted by the spring 5 may be constrained and directed, thereby imparting not only pivotal movement of arm 3, and in turn reflector 1, but radial movement as well. In this fashion, the arm 3 can be moved throughout the entire range of motion of the joint 4. The joint 4, is acting as a spherical hinge around which support arm 3, and in turn reflector 1, can be made to follow a spherical path around the focal point 12 wherein resides illuminator 2. FIG. 3 shows the distribution of forces and tensions in the system as the motors 7 selectively lengthen and shorten the wires 6. The motors may be of any type commonly known in the art, such as step motors, or any other motor capable of finely controlled movements.

It can be seen then that as the reflector follows the spherical path defined around the fixed illuminator which resides at the focal point of the reflector, the beam axis of the antenna can be coincidentally varied as the reflector moves. The scanning capabilities of the antenna, and also the pointing capabilities of the antenna, are limited only by the range of motion of the universal joint and the degree of precision to which the reflector can be positioned by the combination of tension spring 5, motor 7 and wire 6. Since very fine motor control systems are currently available in the art, it follows that very precise positioning of the antenna assembly is possible using the technique of the present invention. Extremely small losses due to scan are obtained (lower than 0.3 to 0.5 db) within a very wide scan field, typically in the order of 40 times the antenna beamwidth according to conventional antenna design criteria (adopting usual edge taper values in the range between 5 and 15 db). Even wider scan fields are possible in accordance with the present invention by simply increasing the dimension of the reflector and leaving the illuminator and feed unchanged. Large reflector dimensions are possible in space-based application due to the reduced inertial concerns in a gravity free environment.

Additionally, since a fixed feed system can be adopted, due to the fact that illuminator 2 is held in a constant position at focal point 12 relative to reflector 1, the elimination of the need for rotary joints (rotative wave guide connectors or rotating coaxial connectors) thereby reduces possible RF losses and also avoids undesirable modulation effects induced in the RF signals fed to the antenna introduced by such components. The present antenna system can be used for acquisition of angle tracking systems using either monopulse, conical scan or step tracking techniques. It should further be recognized that the illuminator can be of an isotropic or anisotropic type, or the antenna may be designed with one or multiple reflectors capable of said spherical movement to provide multiple beam axes.

The present invention also lends itself particularly well to antenna systems where multiple feeds are required, since multiple illuminators may be provided with fixed connectors thereby eliminating the need for articulating connectors for many feed lines which would be an extremely difficult situation to implement.

Optionally, the antenna system may be additionally supplied with angle detectors 9 positioned at the rotative portions of the joint 4. In this way it may be possible to optimize the configuration of the RF sensor for the detection of the error angle of the antenna in a given direction related to an arriving signal, eliminating the need for the use of minimum wave guide connection RF sensors which are usually limited in performance.

The present system finds further use in satellite based applications since the expanded range of movement of the reflector may be used to facilitate the unfolding of the antenna as it is deployed in a space-based satellite. Other considerations in satellite based applications are the relative simplicity of the articulating mechanisms of the present invention, which make them less susceptible to binding and therefore more suitable to critical space-based communication applications.

Figure 4A:
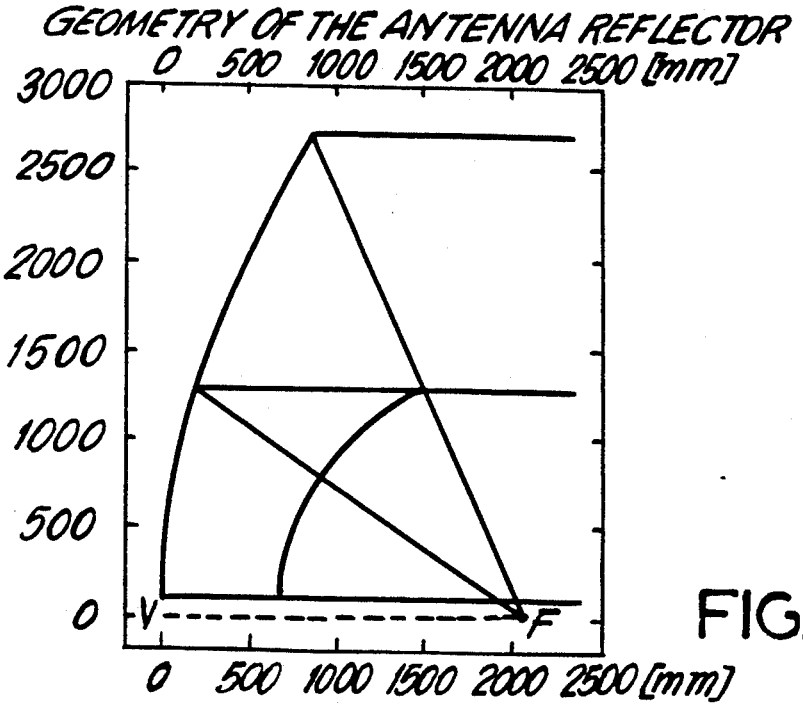
FIG. 4A is a graphical representation of the antenna scan geometry.
Figure 4B:
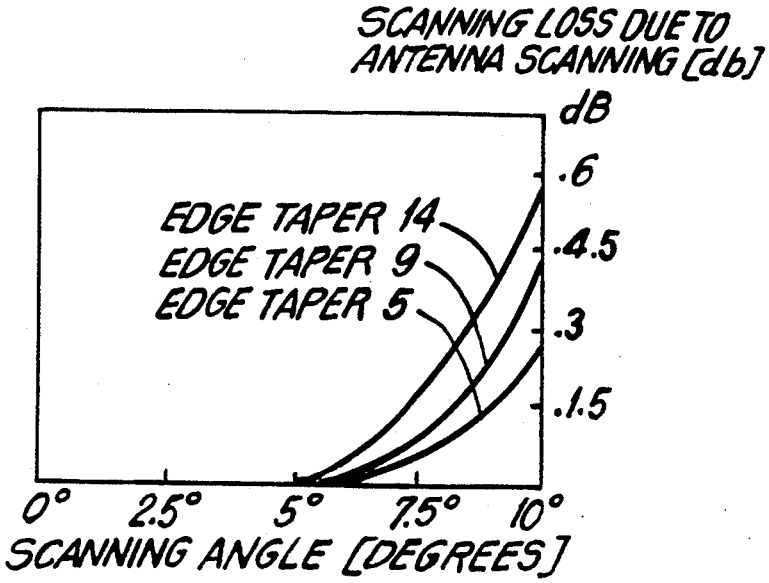
FIG. 4B is a graphical representation of the scan loss curves for the antenna system of the present invention.

The system is particularly well suited in antennas which require the fixed feed system to be of the phased array type, or of the matrix beam forming type, where the phase relationship on each single channel must be precisely maintained during scan conditions. Since the focal distance between reflector 1 and illuminator 2 is consistently maintained, the phase relationships can be successfully maintained throughout scanning movement. Examples of the scan geometry of the antenna of the present invention are represented in FIG. 4A, and a graphical representation of the scan losses (which can be considered negligible) are represented in FIG. 4B.

Figure 5:
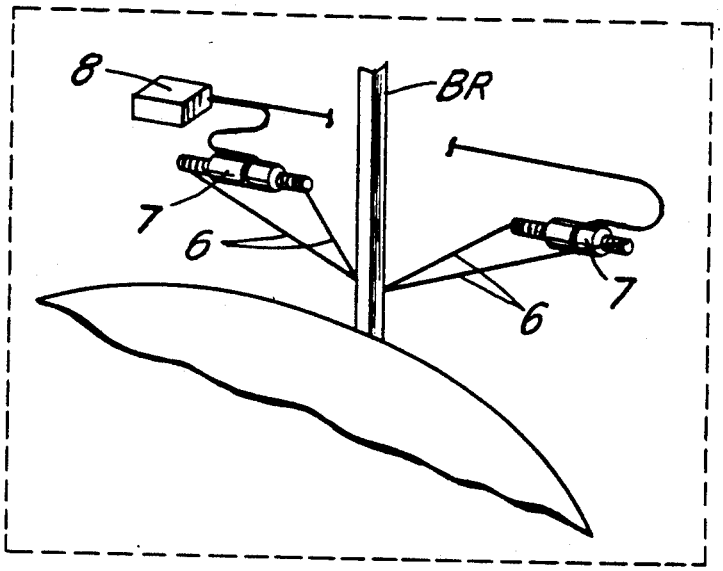
FIG. 5 is a diagrammatic representation of an alternate embodiment of the present invention utilizing redundant guide wires.
Figure 6A:
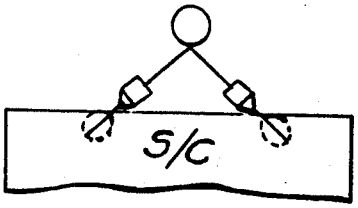
FIGS. 6A through 6E show diagrammatic representations of the system using alternative actuating devices such as linear actuators and spherical joints.
Figure 6B:
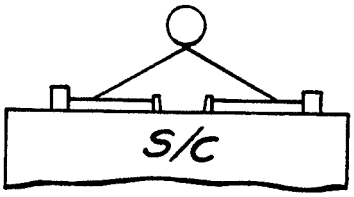
Figure 6C:
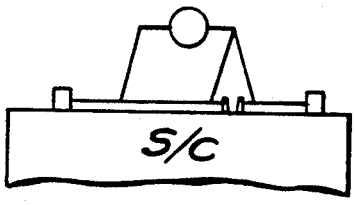
Figure 6D:
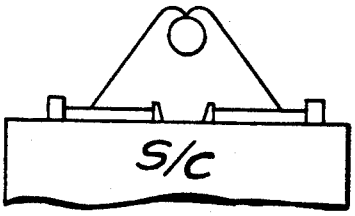
Figure 6E:
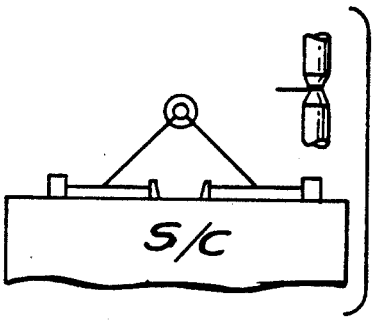

In particularly critical applications, it may be desirable to implement the system with some level of redundancy. FIG. 5 is a representation of a redundant system wherein four guide wires are supplied, each guide wire being controlled by an individual motor having a grooved capstan as previously described. Element 8 is a representation of the motor control system which controls motors 7. Such motor control systems are well known in the art and need not be described in detail here, however it is obvious in a redundant system that the control unit 8 may be redundantly supplied as well.

FIGS. 6A through 6E show diagrammatic representations of the system in accordance with the instant invention using alternative actuating devices such as linear actuators and spherical joints.

Therefore it can be seen that a highly flexible, accurate, and reliable antenna pointing system is achieved using the apparatus of the present invention.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. An apparatus for the fine positioning of a reflector-type antenna, comprising:

a reflector having a focal point;

an illuminator disposed in a fixed position at said focal point;

means for guidedly moving said reflector through a predetermined range of motion, said range of motion substantially defining a sphere, said spherical range of motion having a constant radius of predetermined length and a center coinciding with said illuminator; and means for maintaining the focal point of said reflector coincident with said center of said spherical range of motion as said reflector is guidedly moved through said spherical range of motion, said maintaining means comprising;

an arm having a first end proximate to and rotatable around said illuminator, a second end attached to said reflector, and a predetermined length, said length being selected so as to maintain the focal point of said reflector coincident with the center of said spherical range of motion throughout said spherical range of motion.

2. The apparatus according to claim 1, wherein said means for guidedly moving said reflector through said spherical range of motion comprises:

a Cardanic joint having a range of motion for providing articulated pivotal and radial movement of said arm around said illuminator, said joint having a first joint part for permitting movement in a horizontal plane and a second joint part for permitting movement in a vertical plane; said second joint part being attached to said first end of said arm; and means for simultaneously moving said arm radially and pivotally throughout said range of motion of said joint.

3. The apparatus according to claim 2, wherein said means for simultaneously moving said arm radially and pivotally throughout said range of motion of said joint comprises:

a motor having a capstan;

a guide wire windable about said capstan and fixed at one end to said arm at a point proximate said second end of said arm for selectively exerting tension upon said arm; and springs mounted in said Cardanic joint for imparting rotative movement between said first joint part and said second joint part so that as said guide wire selectively exerts tension upon said arm, the arm is made to follow a radial, pivotal path throughout the range of motion of said joint, so as to guidedly move said reflector through a said spherical range of motion.

4. The apparatus according to claim 1, wherein said reflector has a focal length coinciding with said radius of said spherical range of motion.

5. An apparatus for fine positioning of a reflector-type antenna, comprising:

a reflector having a focal point;

an illuminator disposed in a fixed position at said focal point;

means for guidedly moving said reflector along a predetermined path, said path defining a sphere, said sphere having a constant radius of predetermined length and a center coinciding with said illuminator;

said reflector having a focal length coinciding with the radius of said sphere;

an arm having a first end proximate to and rotatable around said illuminator, and a second end attached to said reflector; and wherein said means for guiding said reflector along said predetermined spherical path comprises:

a Cardanic joint having a range of motion for providing articulated pivotal radial movement of said arm around said illuminator, said joint having a first joint part for permitting movement in a first plane and a second joint part for permitting movement in a second plane, said second joint part being attached to said first end of said arm;

a motor having a capstan;

a guide wire windable about said capstan and fixed at one end to said arm at a point proximate said second end of said arm for selectively exerting tension upon said arm; and springs mounted in said Cardanic joint for imparting rotative movement between said first joint part and said second joint part so that as said guide wire selectively exerts tension upon said arm, the arm is guidedly moved so as to follow a radial, pivotal path throughout the range of motion of said joint, said arm simultaneously guidedly moving said reflector along said predetermined spherical path such that said focal point of said reflector and said illuminator remain coincident as said reflector is guidedly moved along said predetermined spherical path.

* * * * *